US009637900B2

(12) United States Patent
Yang

(10) Patent No.: US 9,637,900 B2
(45) Date of Patent: May 2, 2017

(54) FLUSH HANDLE ASSEMBLY

(71) Applicant: HOME MORE ENTERPRISE CO., LTD., Changhua (TW)

(72) Inventor: Li-Fen Yang, Taichung (TW)

(73) Assignee: Home More Enterprise Co., Ltd., Changhua (TW)

( * ) Notice: Subject to any disclaimer, the term of this patent is extended or adjusted under 35 U.S.C. 154(b) by 80 days.

(21) Appl. No.: 14/751,150

(22) Filed: Jun. 26, 2015

(65) Prior Publication Data

US 2016/0376780 A1 Dec. 29, 2016

(51) Int. Cl.
*E03D 5/00* (2006.01)
*E03D 5/092* (2006.01)

(52) U.S. Cl.
CPC ..... *E03D 5/092* (2013.01)

(58) Field of Classification Search
CPC ..... E03D 5/09; E03D 5/092; E03D 5/094
USPC ..... 4/405, 411–414
See application file for complete search history.

(56) References Cited

U.S. PATENT DOCUMENTS 5,400,445 A * 3/1995 Hull ..... E03D 5/092 4/325
5,500,961 A * 3/1996 Tsai ..... E03D 1/144 4/325
9,032,560 B2 * 5/2015 Lambert ..... E03D 5/02 4/324
9,469,980 B2 * 10/2016 Le ..... E03D 5/092

* cited by examiner

*Primary Examiner* — Erin Deery
(74) *Attorney, Agent, or Firm* — Rosenberg, Klein & Lee

(57) ABSTRACT

A flush handle assembly for a toilet includes a locking unit having a locking member extending through the wall of the water tank, and a sleeve positions the locking member at the water tank. A shaft extends through the locking member and a flush handle is connected to the first end of the shaft. The second end of the shaft protrudes from the locking member and is connected to a positioning member which is connected with a link. The second end of the shaft has two plates with a slot formed therebetween. The locking member has a groove which is located in the recess of the positioning member and a pin extends through the positioning member and is engaged with the groove of the locking member to connect positioning member to the locking member. The shaft is removed from the positioning member by squeezing the two plates of the shaft.

4 Claims, 8 Drawing Sheets

FLUSH HANDLE ASSEMBLY

BACKGROUND OF THE INVENTION

1. Fields of the Invention

The present invention relates to a flush handle assembly, and more particularly, to a flush handle assembly that is easily replaced and maintained.

2. Descriptions of Related Art

The conventional flush handle assembly for a toilet includes a flush handle pivotably connected to outside of the water tank, and a locking unit located at the inside of the water tank to position the flush handle. The locking unit also is connected with a link which is connected to the flapper chain so as to activate the valve to allow the water in the water tank to flush into the bowl. A two-stage toilet flush assembly is developed to allow the users to choose desired amount of water to flush. The two-stage toilet flush assembly comprises a housing, a gear set, a ring-shaped disk, a link unit and a driving unit. The driving unit has a first handle and a second handle, the two handles respectively controls different amount of water to flush. However, the conventional two-stage flush assembly includes too many parts which become a burden for replacement and maintenance.

The present invention intends to provide a flush handle assembly to eliminate the shortcomings mentioned above.

SUMMARY OF THE INVENTION

The present invention relates to a flush handle assembly for a toilet, and comprises a locking unit having a locking member and a sleeve. The locking member extends through the wall of the water tank, and has a passage defined axially therethrough. The first end of the locking member is located on outside of the water tank. A tubular portion extends from the first end of the locking member and a protrusion extends radially from the tubular portion. The second end of the locking member is located in the water tank. A groove is defined in the outside of the second end of the locking member. The sleeve is located in the water tank and threadedly connected to the locking member. A torsion spring is mounted to the tubular portion and has an insertion end and a contact end. The insertion end extends through the tubular portion, and the contact end is engaged with the protrusion. A flush unit has a flush handle and a shaft, wherein the shaft extends through the passage of the locking member and has a first end and a second end. The first end of the shaft is located on outside of the water tank. The flush handle is connected to the first end of the shaft. The second end of the shaft has two plates between which a slot is defined.

A positioning member is located in the water tank and connected to the shaft. The positioning member has a recess, and the second end of the locking member is inserted in the recess. The second end of the shaft is inserted through the recess and connected to the positioning member. The positioning member has a toothed disk, and a link has an end engaged with the toothed disk. A pin extends through the positioning member and is inserted in the recess and engaged with the groove of the locking member. The flush unit is pulled out from the positioning member by removing the second end of the shaft from the positioning member.

Preferably, the shaft, from the first end to the second end, has a first section, a second section, a third section and a fourth section. The cross sectional area of the second section is larger than that of the first section and the third section. The first section is connected with the flush handle. The second section has a shoulder relative to the third section.

The third section is inserted in the passage of the locking member. The fourth section is inserted in the recess of the positioning member and contacts the inner end of the recess.

Preferably, the inner end of the recess has a rectangular hole. The second end of the shaft has two plates divided by the slot. The two plates each are a rectangular plate and engaged with the rectangular hole.

Preferably, the pin has an insertion portion, a bent portion and a U-shaped portion which is connected between the insertion portion and the bent portion. The insertion portion is inserted into the positioning member and reaches the interior of the recess and is engaged with the groove of the locking member. The bent portion has a straight portion and a curved portion. The straight portion is parallel to the insertion portion. The positioning member is clamped between the insertion portion and the curved portion.

The primary object of the present invention is to provide a flush handle assembly which is easily maintained without detaching all of the parts from the water tank.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
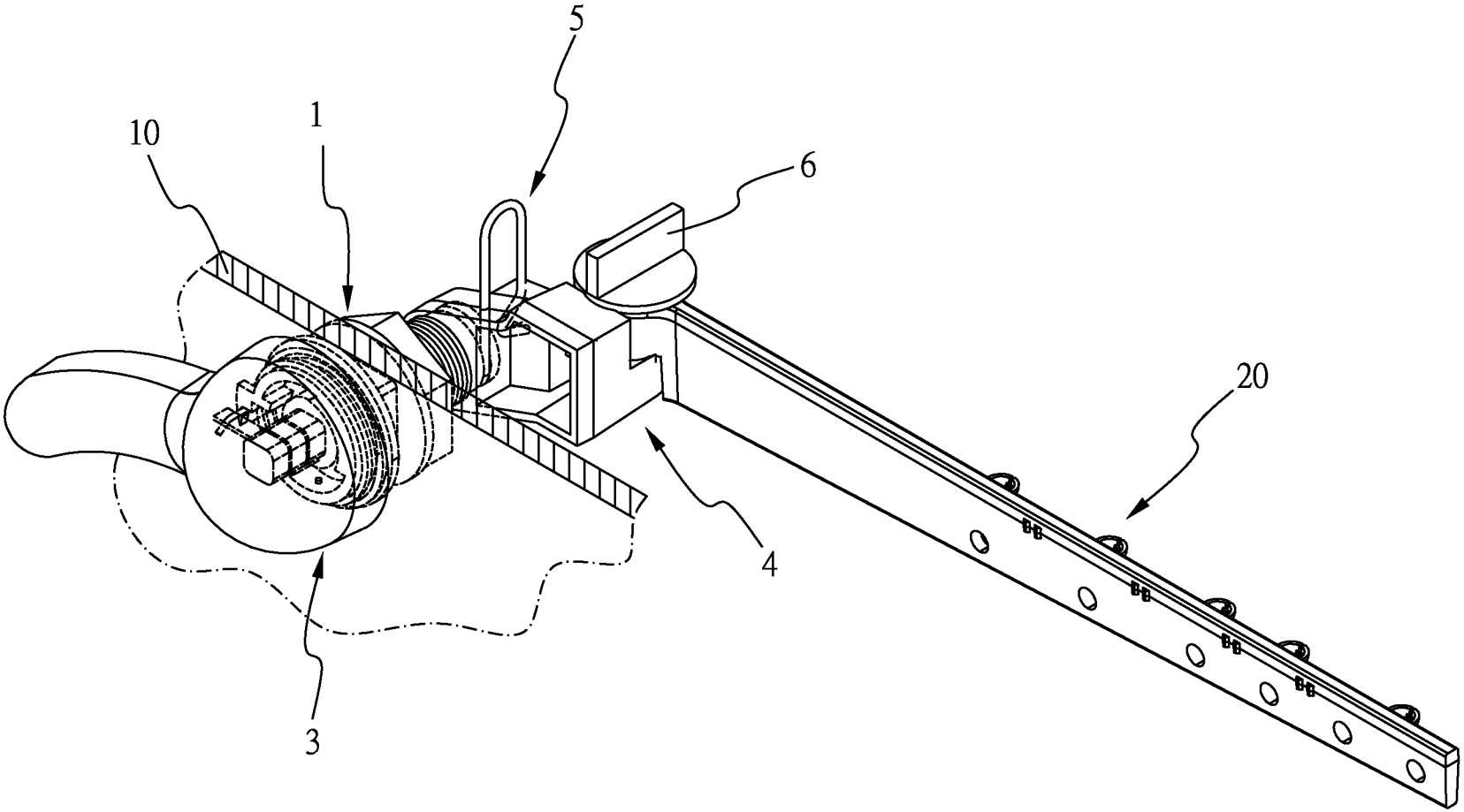
FIG. 1 is a perspective view to show the flush handle assembly of the present invention.
Figure 2:
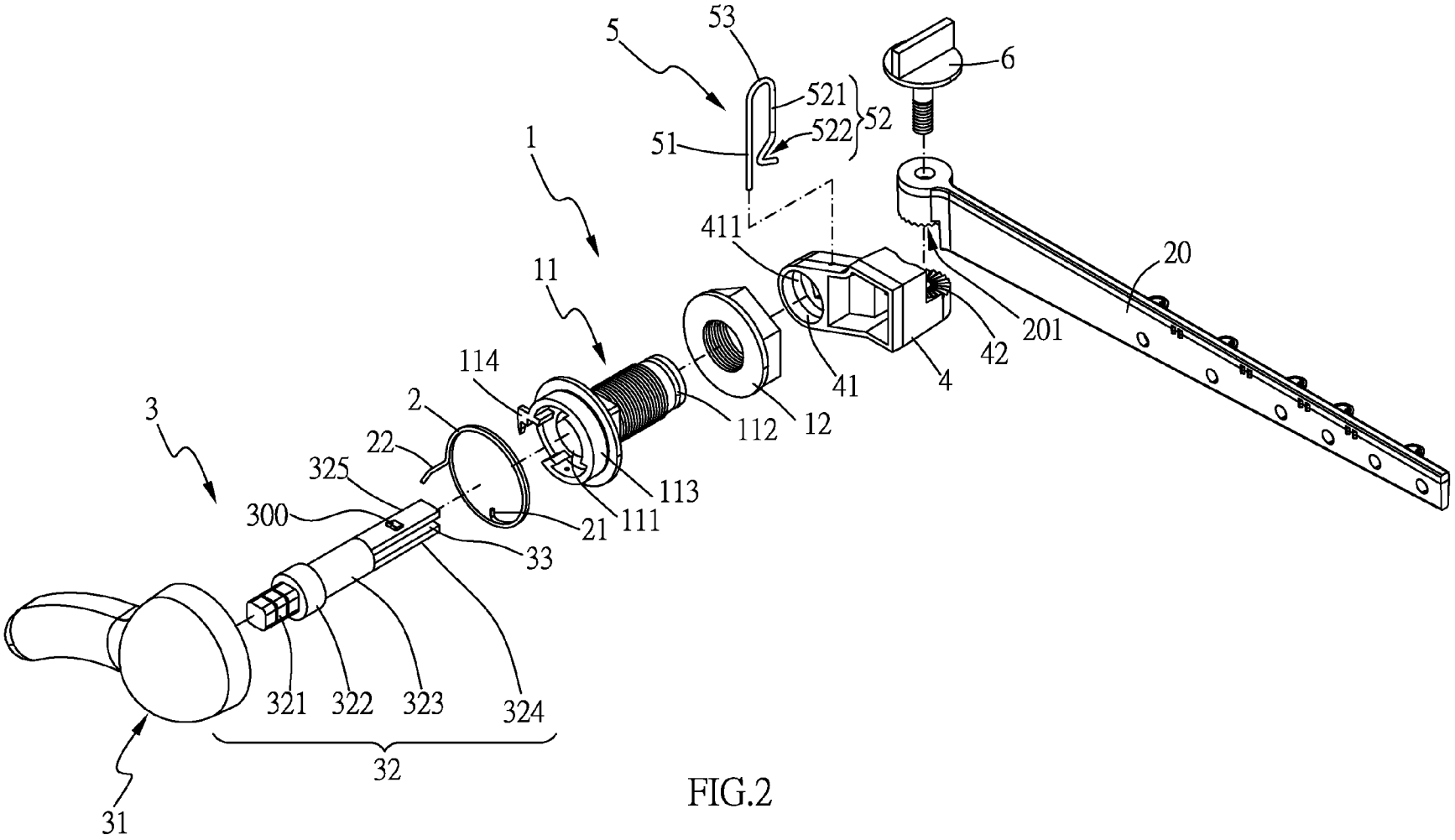
FIG. 2 is an exploded view of the flush handle assembly of the present invention.
Figure 3:
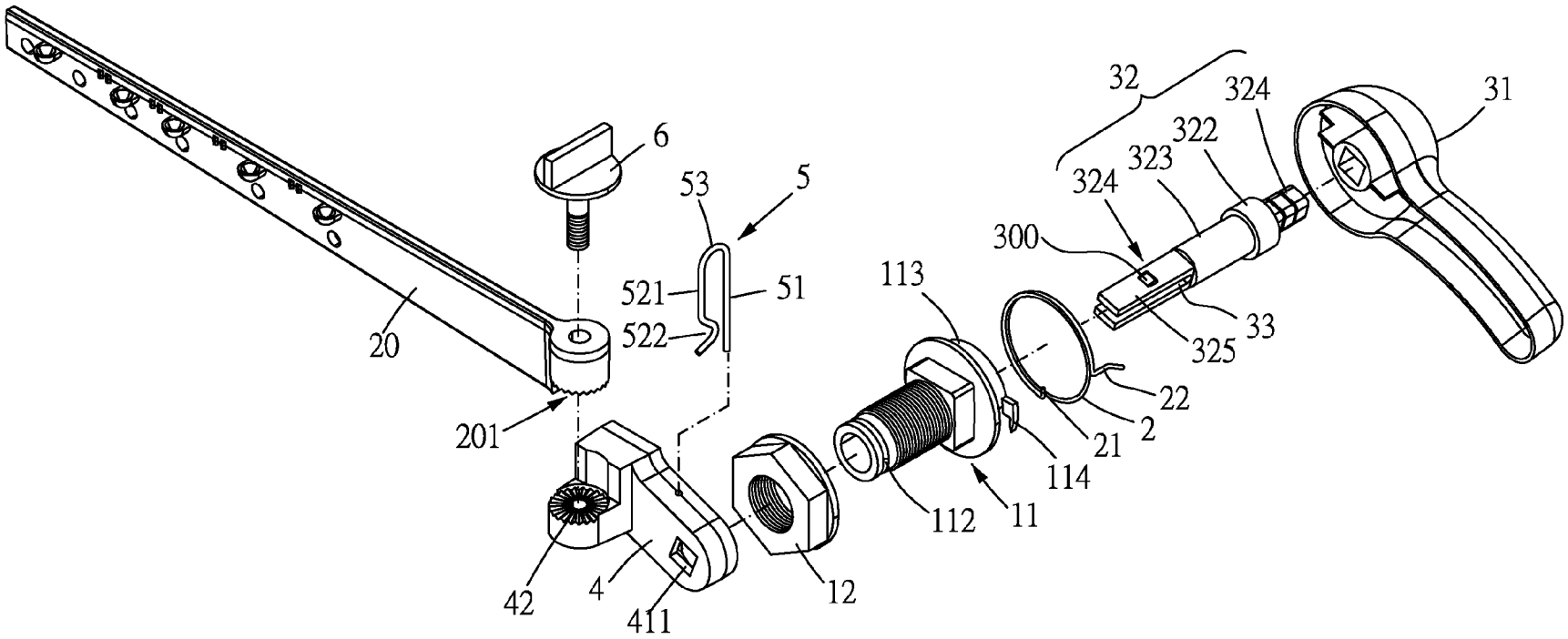
FIG. 3 is another exploded view of the flush handle assembly of the present invention.
Figure 4:
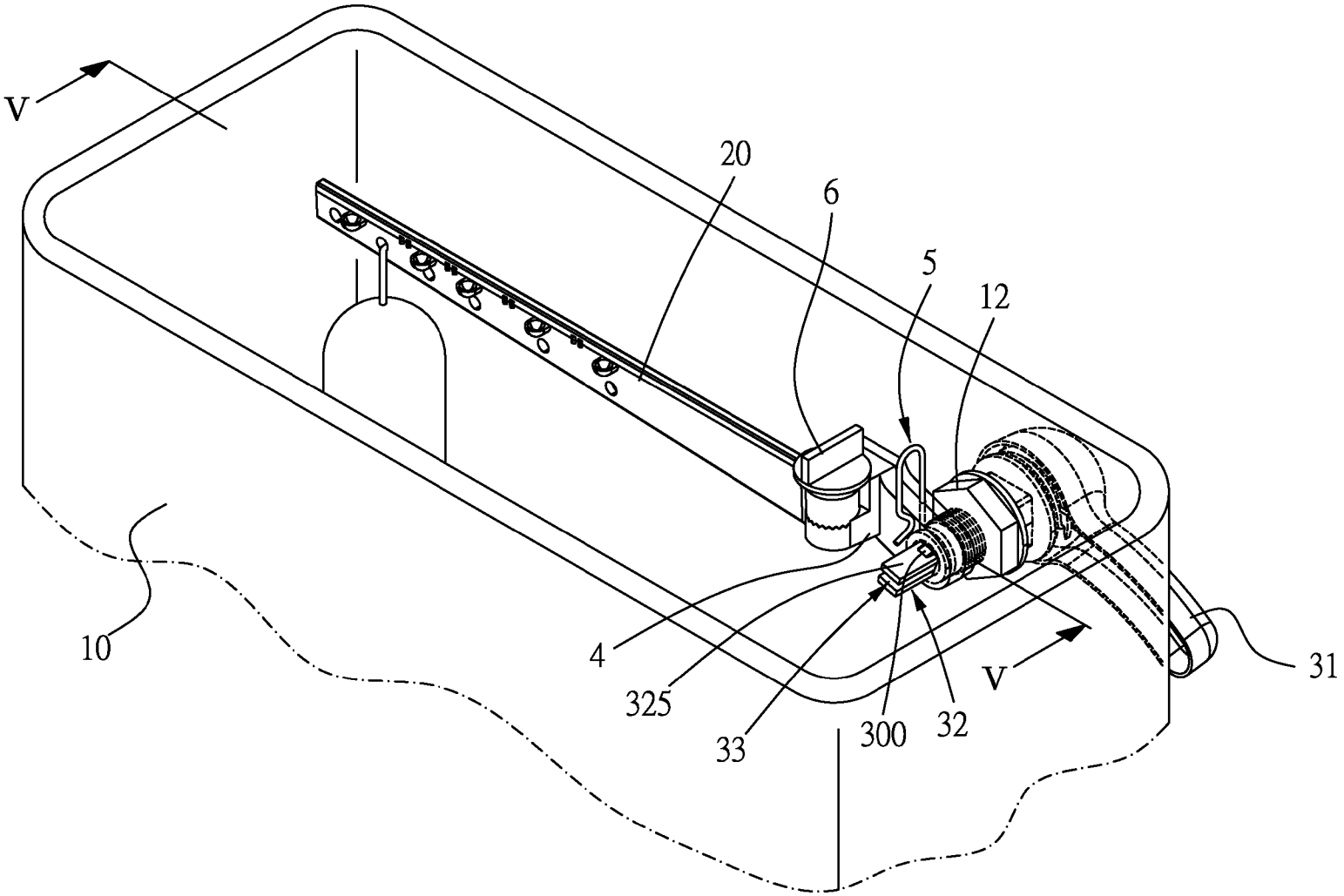
FIG. 4 shows that the flush handle assembly of the present invention is installed to a water tank.
Figure 5:
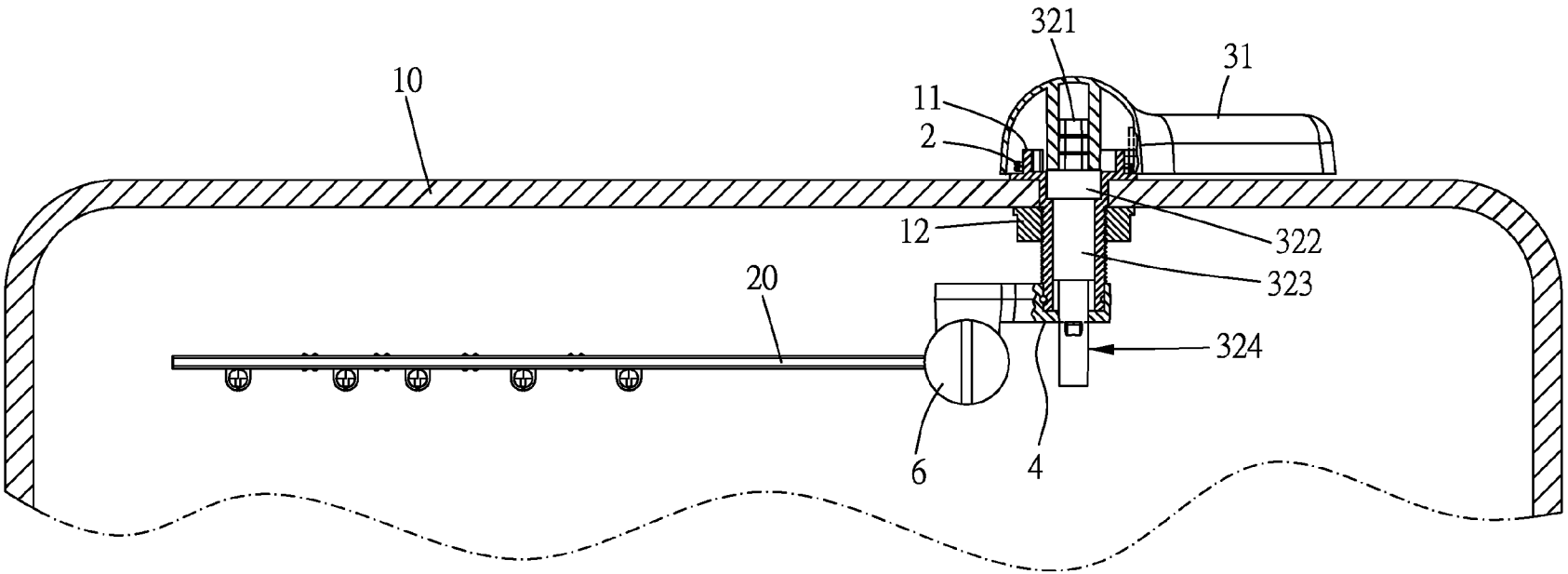
FIG. 5 is a cross sectional view, taken along line A-A in FIG. 4.

Referring to FIGS. 1 to 6, the flush handle assembly for a toilet of the present invention comprises a locking unit having a locking member 11 and a sleeve 12. The locking member 11 extends through the wall of the water tank 10, and a passage 111 is defined axially through the locking member 11. The first end of the locking member 11 is located on outside of the water tank 10, and a tubular portion 113 extends from the first end of the locking member 11. An L-shaped protrusion 114 extends radially from the tubular portion 113. The second end of the locking member 11 is located in the water tank 10, and a groove 112 is defined in the outside of the second end of the locking member 11. The sleeve 12 is located in the water tank 10 and threadedly connected to the locking member 11 so as to attach the locking member 11 to the water tank 10.

A torsion spring 2 is mounted to the tubular portion 113 and has an insertion end 21 and a contact end 22 which is perpendicular to the insertion end 21. The insertion end 21 extends through the tubular portion 113, and the contact end 22 is engaged with the protrusion 114.

A flush unit 3 has a flush handle 31 and a shaft 32. The shaft 32 extends through the passage 111 of the locking member 11 and has a first end and a second end. The first end of the shaft 32 is located on outside of the water tank 10, and the flush handle 31 connected to the first end of the shaft 32. The second end of the shaft has two elongate rectangular plates 325 extending therefrom, and a slot defined between the two plates 325. Each plate 325 has a triangular tab 300 extending from the outside thereof.

A positioning member 4 is located in the water tank 10 and connected to the shaft 32. The positioning member 4 has a recess 41 defined in one end thereof and the second end of the locking member 11 is inserted in the recess 41. The other end of the positioning member has a toothed disk 42. A link 20 has a toothed face 201 defined in an end thereof, the toothed face 201 is engaged with the toothed disk 42, and the other end of the link 20 is connected with a flapper chain (not shown). A bolt 6 extends through the end with the toothed face 201 of the link 20 and is connected to the positioning member 4. The engagement between the toothed face 201 and the toothed disk 42 allows the link 20 to be set at a desired angular position relative to the positioning member 4 to meet different needs of different water tanks 10. The inner end of the recess 41 has a rectangular hole 411. The second end of the shaft 32 is inserted through the recess 41 and the two plates 325 divided by the slot 33 are engaged with the rectangular hole 411. Specifically, the two plates 325 can be squeezed toward each other to allow the triangular tabs 300 to pass through the rectangular hole 411 until the triangular tabs protrude out from the rectangular hole 411, the two plates 325 are released and the triangular tabs 300 are engaged with the rear side of the positioning member 4 and contact two sides of the rectangular hole 411.

A pin 5 extends through the positioning member 4 and is inserted in the recess 41 and engaged with the groove 112 of the locking member 11 so as to connect the positioning member 4 to the locking member 11. Specifically, the pin 5 has an insertion portion 51, a bent portion 52 and a U-shaped portion 53 which is connected between the insertion portion 51 and the bent portion 52. The insertion portion 51 is inserted into the positioning member 4 and reaches the interior of the recess 41 and is engaged with the groove 12 of the locking member 11. The bent portion 52 has a straight portion 521 and a curved portion 522. The straight portion 521 is parallel to the insertion portion 51. The positioning member 4 is clamped between the insertion portion 51 and the curved portion 522.

The shaft 32, from the first end to the second end, has a first section 321, a second section 322, a third section 323 and a fourth section 324. The cross sectional area of the second section 322 is larger than that of the first section 321 and the third section 323. The first section 321 is a rectangular section and is connected with the flush handle 31. The second section 322 has a shoulder relative to the third section 323. The third section 323 is inserted in the passage 111 of the locking member 11, and the fourth section 324 is inserted in the recess 41 of the positioning member 4 and contacts the inner end of the recess 41.

Figure 6:
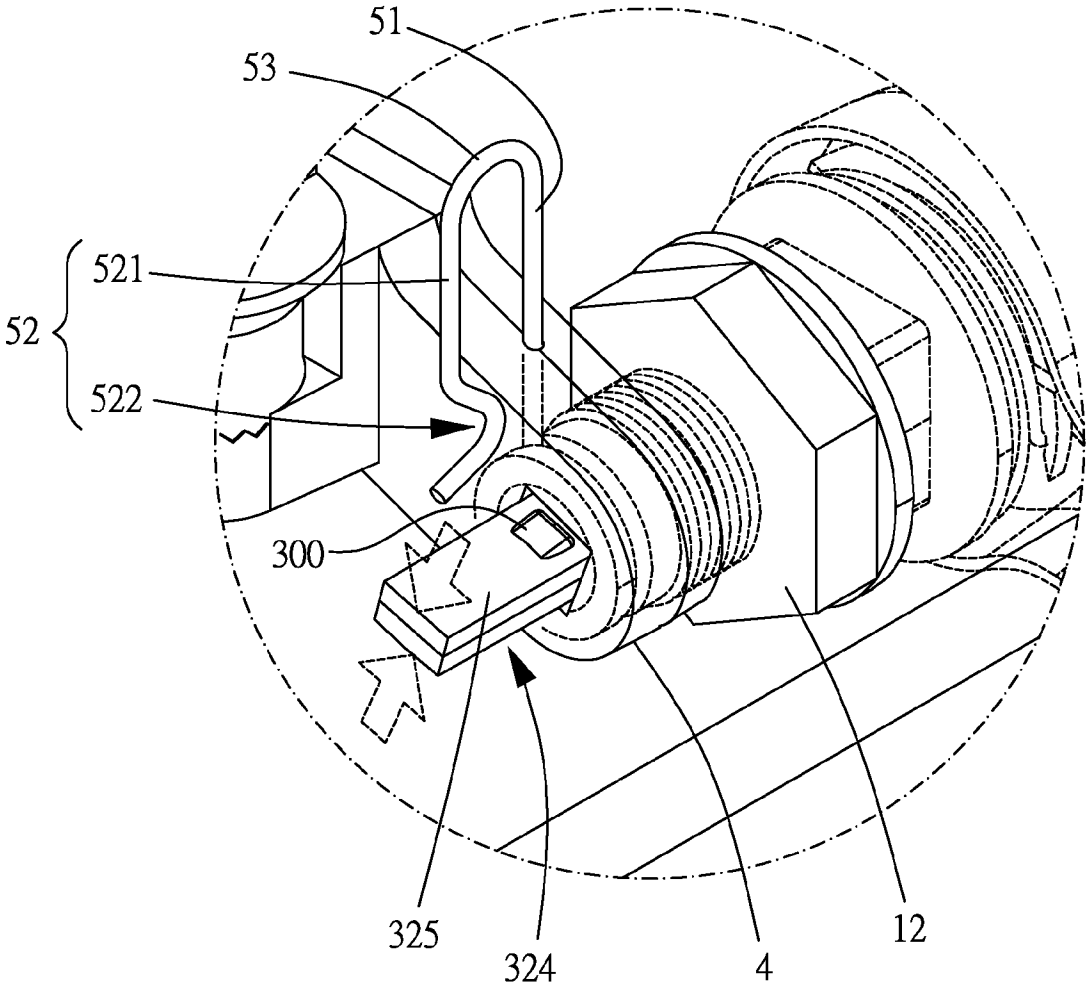
FIG. 6 is an enlarged view to show the two plates of the shaft is squeezed to be disengaged from the rectangular hole of the positioning member.
Figure 7:
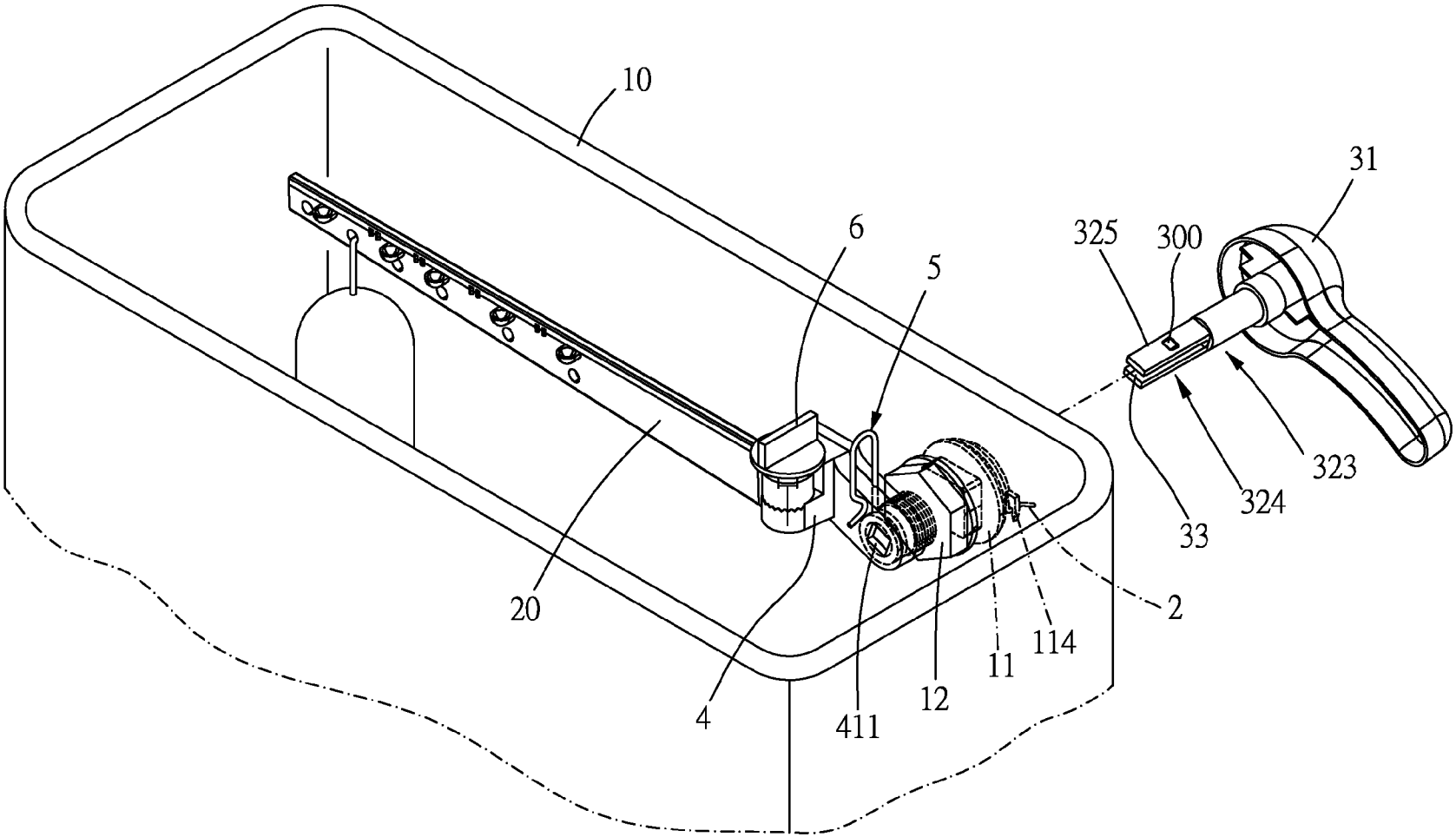
FIG. 7 shows that the flush handle and the shaft are pulled out from the locking member.

As shown in FIGS. 6 and 7, when replacing the flush unit 3, the user squeezes the two plates 325 toward each other and the two triangular tabs 300 are moved toward each other so as to be allowed to pass through the rectangular hole 411. Therefore, the second end of the shaft 32 can be pulled from the rectangular hole 411, the recess 41 of the positioning member 4, and the locking member 11 as shown in FIG. 7.

When the locking member 11 needs to be replaced, the user pulls the pin 5 out from the positing member 4, so that the pin 5 is disengaged from the groove 112 of the locking member 11. The sleeve 12 and the locking member 11 are threadedly separated from each other. The sleeve 12 and the locking member 11 are removed from the water tank 10 and to be replaced. The processes are easy and convenient for the users. It is not necessary to remove all of the parts of the flush unit 3 and the locking unit 1 from the water tank 10.

Figure 8:
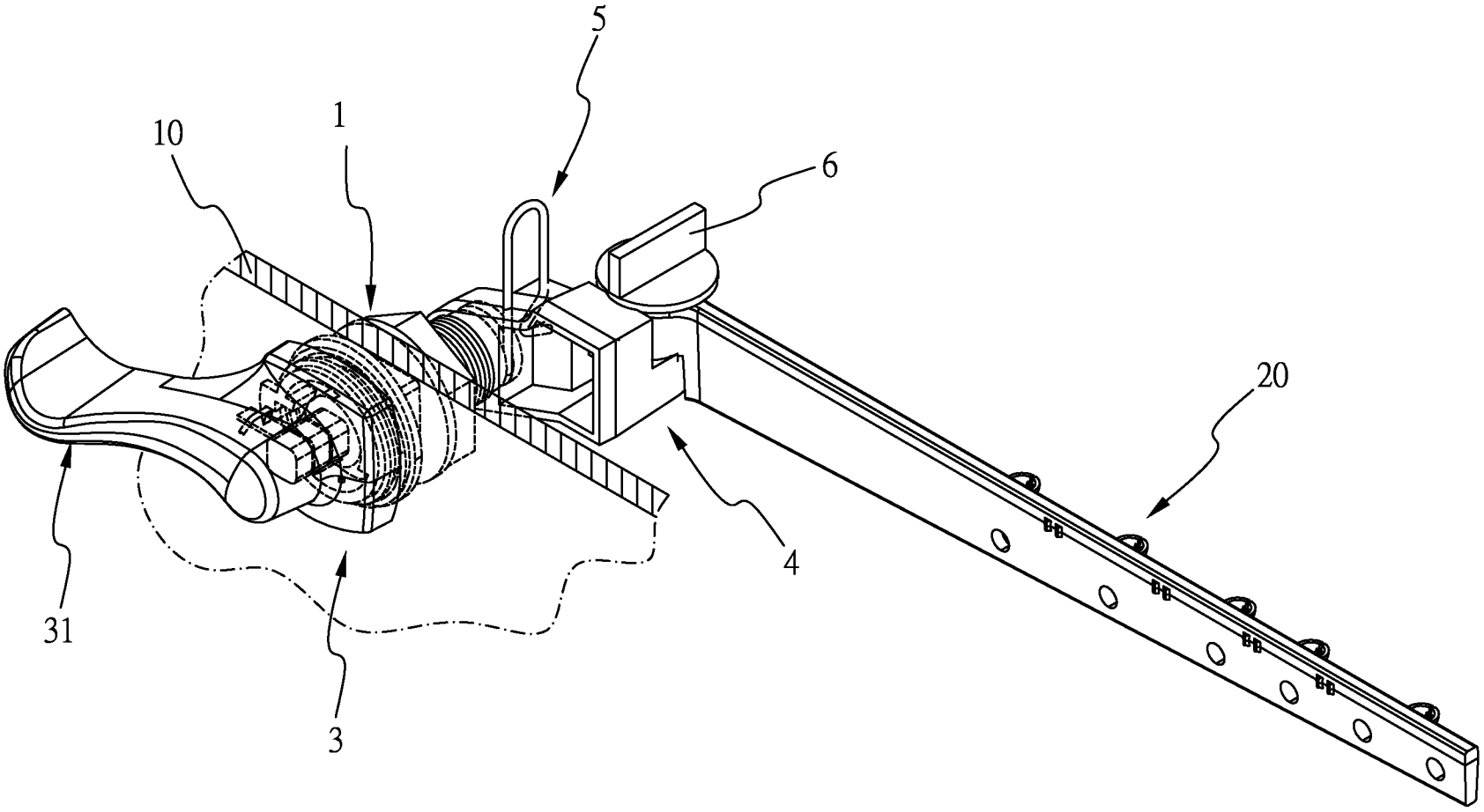
FIG. 8 shows another embodiment of the flush handle of the present invention.

FIG. 8 shows that different type of flush handle 31 can be used with the shaft 32 of the flush unit 3.

While we have shown and described the embodiment in accordance with the present invention, it should be clear to those skilled in the art that further embodiments may be made without departing from the scope of the present invention.

What is claimed is:

1. A flush handle assembly, comprising:

a locking unit having a locking member and a sleeve, the locking member adapted to extend through a wall of a water tank, a passage defined axially through the locking member, a first end of the locking member adapted to be located on outside of the water tank, a tubular portion extending from the first end of the locking member and a protrusion extending radially from the tubular portion, a second end of the locking member adapted to be located in the water tank, a groove defined in an outside of the second end of the locking member, the sleeve adapted to be located in the water tank and threadedly connected to the locking member;

a torsion spring mounted to the tubular portion and having an insertion end and a contact end, the insertion end extending through the tubular portion, the contact end engaged with the protrusion;

a flush unit having a flush handle and a shaft, the shaft extending through the passage of the locking member and having a first end and a second end, the first end of the shaft adapted to be located on outside of the water tank, the flush handle connected to the first end of the shaft, the second end of the shaft having a slot defined therein, and a positioning member adapted to be located in the water tank and connected to the shaft, the positioning member having a recess and the second end of the locking member inserted in the recess, the second end of the shaft inserted through the recess and connected to the positioning member, the positioning member having a toothed disk, a link having an end engaged with the toothed disk, a pin extending through the positioning member and inserted in the recess and engaged with the groove of the locking member, the flush unit being pulled out from the positioning member by removing the second end of the shaft from the positioning member.

2. The flush handle assembly as claimed in claim 1, wherein the shaft, from the first end to the second end, has a first section, a second section, a third section and a fourth section, a cross sectional area of the second section is larger than that of the first section and the third section, the first section is connected with the flush handle, the second section has a shoulder relative to the third section, the third section is inserted in the passage of the locking member, the fourth section inserted in the recess of the positioning member and contacts an inner end of the recess.

3. The flush handle assembly as claimed in claim 2, wherein the inner end of the recess has a rectangular hole, the second end of the shaft has two plates divided by the slot, the two plates each are a rectangular plate and engaged with the rectangular hole.

4. The flush handle assembly as claimed in claim 1, wherein the pin has an insertion portion, a bent portion and a U-shaped portion which is connected between the insertion portion and the bent portion, the insertion portion is inserted into the positioning member and reaches an interior of the recess and is engaged with the groove of the locking member, the bent portion has a straight portion and a curved portion, the straight portion is parallel to the insertion portion, the positioning member is clamped between the insertion portion and the curved portion.

* * * * *